United States Patent [19]

Dolezal

[11] Patent Number: 4,915,062

[45] Date of Patent: Apr. 10, 1990

[54] ONCE-THROUGH STEAM GENERATOR

[75] Inventor: Richard Dolezal, Stuttgart, Fed. Rep. of Germany

[73] Assignee: GEA Luftkühlergesellschaft Happel GmbH & Co., Fed. Rep. of Germany

[21] Appl. No.: 281,850

[22] Filed: Dec. 8, 1988

[30] Foreign Application Priority Data

Dec. 10, 1987 [DE] Fed. Rep. of Germany ..... 3741881

[51] Int. Cl.[4] ..... E22D 7/00

[52] U.S. Cl. ..... 122/406 ST; 122/7 R; 122/420; 122/470

[58] Field of Search ..... 122/7 R, 420, 470, 406 ST

[56] References Cited

U.S. PATENT DOCUMENTS

| | | | |
|---|---|---|---|
| 1,263,586 | 4/1918 | Meier | 122/420 |
| 3,254,631 | 6/1966 | Taylor | 122/7 R |
| 3,420,054 | 1/1969 | Sheldon | 122/7 R |
| 4,501,233 | 2/1985 | Kusaka | 122/7 R X |
| 4,693,213 | 9/1987 | Yanai et al. | 122/7 R |

*Primary Examiner*—Edward G. Favors

*Attorney, Agent, or Firm*—Toren, McGeady & Associates

[57] ABSTRACT

A once-through steam generator comprises an economizer, an evaporator and a superheater connected in series one below the other in a boiler pass, and are acted upon by a hot gas mass flow flowing in the opposite direction. In order to prevent thermal shock during the introduction of cold feed water when starting the steam generator from a hot state, i.e., with an economizer, evaporator and superheater which are empty and heated to the exhaust gas temperature, a high-temperature starter is connected upstream of the economizer and is arranged above the latter in the boiler pass. The starter acts as a heat buffer so that the economizer, evaporator and superheater are first acted upon by superheated steam and are continuously cooled to their normal operating temperature. The starter is constructed in such a way that its portion which first comes into contact with the cold feed water does not support the steam pressure so that it need only absorb thermal stresses. In normal operation, the starter works as a preheating stage for the economizer.

12 Claims, 4 Drawing Sheets

ONCE-THROUGH STEAM GENERATOR

FIELD AND BACKGROUND OF THE INVENTION

The present invention relates in general to steam generators and, in particular, to a new and useful once-through steam generator having a high-temperature heat accumulator or starter connected upstream of an economizer or evaporator of the steam generator.

Once-through steam generators are used, for example, in combined cycle power stations as waste heat recovery equipment of gas turbines. Such steam generators, which are constructed as once-through boilers, make use of hot exhaust gases of the gas turbines for the purpose of generating additional steam. These exhaust gases generally have a temperature of over 500° C. They can be operated for short periods of time in order to cover peak current requirements.

Known steam generators of this type, for example, as disclosed in *ETV-Register* 45/86, page 59, or *Power*, April 1985, page 118, consist substantially of an economizer, an evaporator, which is connected downstream, and a superheater connected to the evaporator, which are arranged one above the other in a boiler pass. During operation, the exhaust gas mass flow, which is still hot, is conducted through the boiler pass, first through the superheater, then through the evaporator, and lastly through the economizer. The feed water entering the economizer is preheated therein, then arrives at the evaporator where it is evaporated to form wet steam. In the superheater, the wet steam is finally converted to superheated steam and is then fed to a steam turbine. An outlet header is generally included between the evaporator and superheater and between the superheater and the steam turbine.

When the generated steam is not required, e.g., during times of low current consumption, the steam generator is shut down. In systems having an exhaust gas diverter, after interrupting the feed-water feed, the exhaust gases are by-passed from the still running gas turbine through the exhaust gas diverter duct to a chimney. The boiler then cools off.

If no exhaust gas diverter is available, which may be the case in once-through boilers, the water content still present in the boiler when shut down is evaporated by the exhaust gases of the gas turbine which continue to flow through the boiler. The economizer, evaporator and superheater then become empty and their tubes become heated to exhaust gas temperature. In order to put this steam generator which is now in a heated state into operation again, the economizer, the evaporator and the superheater must first be cooled-off to their normal operating temperature by means of the feed water, and the water supply of the boiler must be restored.

When starting up the cooled off steam generator with an exhaust gas diverter, a diverter damper remains open so that the hot exhaust gas mass flow is guided into the atmosphere in a circuitous manner around the economizer, evaporator and superheater so as to be completely unused. During this start-up phase, the economizer and evaporator are refilled with feed water, after which the gas diverter is closed and the hot exhaust gas mass flow is again guided through the boiler pass. To a great extent, this prevents temperature shock, such as would occur by the entry of cold feed water into the boiler which is heated to the exhaust gas temperature.

The use of the gas diverter is costly and maintenance-intensive. The diverter dampers for opening and closing the diverter duct which have correspondingly large dimensions and which block and open the path of the exhaust gas through the boiler, involve considerable problems with respect to tightness. Because of the different local temperatures and the enormous size of the dampers, the dampers often warp and then no longer close so as to be tight. Also, the control and blocking devices for the diverter dampers are costly. Since the diverter duct must conduct the entire volume of exhaust gas around the boiler, it requires additional space for the diverter ducts and increases the costs of the heat recovery system.

If no exhaust gas diverter is provided, the empty steam generator is heated at the exhaust gas temperature after the "evaporization" of all water from the boiler tubes. A disadvantage in these steam generators is that, when starting up the hot steam generator, that is when refilling the boiler with feed water, there are great differences in temperature between the feed water, the economizer and the evaporator tubes which produce large thermal stresses.

SUMMARY OF THE INVENTION

Taking the foregoing as a point of departure, an object of the present invention is to construct a once-through steam generator which can be started up from the heated state without undue thermal stresses which reduce the life of the steam generator tubes.

Accordingly, another object of the present invention is to provide a once-through steam generator which comprises a boiler pass for confining a hot gas mass flow, the boiler containing an economizer, evaporator and superheater connected in series along the flow path with the gas mass flow flowing in a direction from the superheater toward the evaporator and economizer conducting water which is converted to steam in an opposite direction, and a high temperature starter connected to the economizer, upstream of the economizer in the direction of water flow and downstream of the economizer in the hot gas mass flow direction, thus providing additional heating surfaces in the flow path for heating the feed water for starting up the operation of the economizer, evaporator and super-heater.

The solution, according to the invention, is simple in terms of construction and protects the economizer, evaporator and superheater from temperature shock in an effective manner. When starting up the empty, hot steam generator, the hot starter which forms a high-temperature heat accumulator, which is connected upstream of the economizer, forms a thermal buffer which prevents cold feed water from coming into contact with hot tubes of the economizer, evaporator and superheater, previously heated by means of the gas turbine exhaust gas flow.

The starter which is provided for such a purpose absorbs this shock caused by the feed water, which could be damaging to the economizer, evaporator and superheater, so that the tubes of the heating surfaces arranged downstream of the starter can cool off to the operating temperature slowly and smoothly without temperature shock and without the occurrence of high thermal stresses which reduce tube life.

In normal operation or when starting the boiler from a cold state, the starter acts as an additional water preheater and, in so doing, does not impede the generation of steam. Therefore, any means for controlling the water flow to the starter can be dispensed with.

When starting the empty steam generator from the hot state by introducing feed water, this water, which is still cold is first transformed into superheated steam in the starter which has been heated to the exhaust gas temperature during the preceding dry operation of the boiler. Thus, only this superheated steam initially reaches the tubes of the economizer, evaporator and superheater which are likewise at the exhaust gas temperature. To the extent that the starter releases the accumulated heat and thereby cools off, super-heated steam at a lower temperature flows into the economizer from the starter, which is then followed by saturated and later, wet steam, and finally by hot water. In this way, the economizer, like the evaporator and superheater connected downstream thereof, cool off slowly from the exhaust gas temperature to the normal operating temperature without temperature shock.

This gradual cooling from high temperature, or enthalpy at the starter outlet, as well as the initially moderate heat transfer rate of steam, lessen the intensity of the cool off of the economizer and evaporator tubes and the adjoining headers. The heating surfaces of the steam generator arranged downstream of the starter are thus not subjected to a temperature shock, but rather undergo a continuous cooling. The temperature drop at the economizer inlet, which is delayed by means of the starter, is slowed down further by means of the heat stored in the economizer so that the flow of steam and later water cools the adjacent evaporator tubes with even smaller temperature transients. The greater the distance from the starter inlet, the lower the local temperature transients in the tubes.

A constructional form of the starter which is simple in terms of construction and particularly favorable with respect to occurring thermal stresses comprises one or more heat accumulating elements which are constructed from a plurality of interpenetrating coaxially arranged tubes. The innermost tube receives feed water. An opposite open end of the innermost tube opens into the next coaxial tube. The water then returns outside the innermost tube through the further coaxial tube and is either discharged at an opposite end of the next coaxial tube or again returned into a still further outer coaxial tube. The internal tubes provide a large heat-accumulating heat exchange surface and have the advantage, with the exception of the outermost tube, that they are only heat-loaded, i.e., subjected to heat, and not pressure-loaded. Since the feeding of feed water is effected through the innermost tube, where the greatest thermal stresses occur, the possible tube deterioration, such as cracking in the tube wall, for example, does not result in impairment of the functioning of the starter. The advantage of the coaxial tube arrangement consists in the possibility of free thermal expansion of the internal tubes which are located in the respective surrounding tube with a clearance so as to be freely movable at the other end.

The outermost starter tube which is heated from the outside by means of exhaust gases is initially cooled by means of steam arriving from the internal tubes before it comes into contact with the feed water. Since the steam pressure in the boiler rises slowly, this outer tube is substantially subjected to stresses due to the steam pressure only after the heat release of the starter is terminated. The starter can comprise a plurality of over two coaxially arranged interpenetrating tubes, but it is also possible for only two coaxial tubes which extend along the entire cross section of the starter tubes to form several loops, for example.

It is particularly advantageous if the internal tubes of the starter which are not exposed to a pressure difference are constructed so as to have thin walls. Since the thin-walled tubes are heated substantially more rapidly than thick-walled tubes, the thermal stresses occurring in the tube wall, because of the differences in temperature during starting are smaller, so that thermal expansion can be effected approximately simultaneously in the entire tube wall, which prevents cracking in the protective layer of the tubes and increases the life of the inner tubes.

The construction of such a starter from individual starter elements comprising at least two or more interpenetrating pipes has proven particularly advantageous. According to the required heat capacity, a plurality of these starter elements can then be connected in parallel and arranged above the economizer next to one another and/or one above the other in the boiler pass. Construction of the invention in which three tubes are coaxially interpenetrated with each other has proven particularly advantageous This construction offers a relatively large heat transfer surface, with the possibility of respective free expansion of the two internal tubes while the space requirement remains moderate. Such a starter element is relatively simple to manufacture and therefore has a low production cost.

Another construction of the high-temperature starter according to the present invention comprises a hollow casing through which feed water can flow and which contains an internal tube which is filled with heat accumulating bodies which permit water to flow around them. In this form, the starter capacity is substantially formed by the heat accumulating bodies. The greatest part of the heat exchange surface, namely the surface of the heat accumulating bodies, lies in the internal tube. The bodies exposed to steam pressure from outside are loosely arranged so as to be freely movable. The heat accumulating bodies can therefore expand and contract freely. This construction also offers the advantage that the heat accumulating capacity of the starter can be varied in a simple manner by means of the size and material of the heat accumulating bodies and is accordingly adaptable to given local conditions. The internal tube prevents contact between the water which is fed into the internal tube and the casing supporting the steam pressure. Superheated steam, wet steam and water successively flow through the annular space between the hollow casing and the internal tube.

For reasons relating to strength, a cylindrical shape for the hollow casing is particularly suitable, since the thermal stresses occurring within such a hollow casing are relatively small. In addition, a cylindrical hollow casing ensures a favorable flow characteristic with low flow resistance.

Balls have proven particularly suitable as the heat accumulating bodies, since they do not tend to become jammed with one another and thus can move relative to one another during thermal expansion. In addition, feed water may flow around the balls on all sides so that a large heat transfer surface which can be exploited in practice is formed. This heat transfer surface cannot deteriorate in an uncontrollable manner by means of surfaces adhering together as is the case, for example, in bodies with plane surfaces.

It is also advantageous according to the invention to construct the starter from several elements which can be prefabricated in series in a plant and connected in parallel in a determined quantity according to the boiler dimensions and capacity of the system.

A construction of the invention with a hollow casing with filling which can be electrically heated, is advantageous for outfitting already existing systems with the starter of the invention. In this construction, the hollow casing filling is electrically heatable so that the starter can also be arranged outside the boiler. Then, in order to start the hot steam generator, the starter is first electrically preheated, after which the feed water is admitted to the starter and to the heat exchanger surface connected downstream. In this instance, also, the feed water is preheated inside the starter in the same way as described above, so that temperature shock of the economizer, evaporator and superheater is prevented.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DESCRIPTION OF THE PREFERRED EMBODIMENTS

Figure 1:
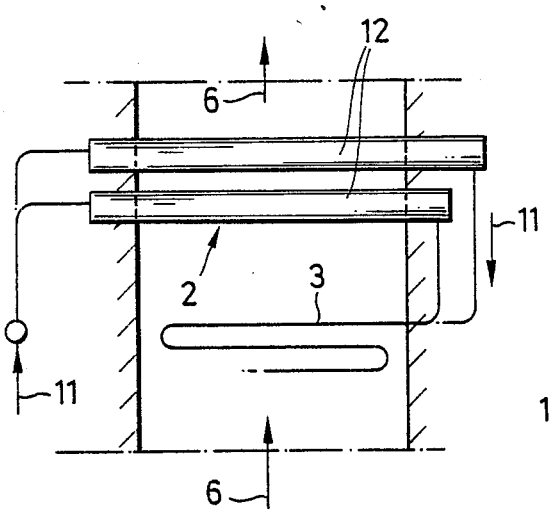
FIG. 1 is a side view of the inventive arrangement for a starter in a once-through boiler.

The once-through boiler shown in FIGS. 1 to 5 substantially comprises a boiler pass 1 in which a high temperature starter 2, an economizer 3, an evaporator 4 and a superheater 5 are arranged one above the other, as seen along the longitudinal axis of the boiler pass. As shown schematically in FIG. 5, the individual structural components 2–5 are arranged inside the boiler pass 1 as tube bundles. During operation, a hot gas mass flow 6 flows around the components 2–5 from the bottom to the top, wherein the hot gas mass flow 6 transforms water fed into the steam generator at 7 into superheated steam at 10.

The admission of feed water into the boiler 1 is effected from the feed-water inlet header 7. From the feed-water header 7 and over a throttle 8 which is provided to insure uniform water distribution to the parallel starter elements, the water first arrives at the top into the heating surfaces located in the boiler pass 1, that is, into the starter 2. From the starter 2, the water flows through connecting tubes to the economizer 3 connected downstream thereof. The outlet of economizer 3 is connected to the evaporator 4 located below it. The evaporator 4 is connected to the superheater 5 located below that by means of an outlet header 9. The outlet of the superheater 5 opens into an outlet header 10 which is connected via steam piping with a steam turbine (not shown). The feed-water and steam flow 11 runs from top to bottom of the boiler pass 1, wherein the hot gas mass flow 6 flows in the opposite direction, from bottom to top, through the boiler pass 1 and, in so doing, converts the feed water in the boiler components 2–5 to superheated steam.

The starter 12 (FIGS. 1 and 2) is arranged above the economizer 3 in the boiler pass 1 transversely relative to the boiler axis so as to be parallel to one another. The elements 12 are arranged in the water flow in parallel, their construction can be seen particularly from FIGS. 3 and 4.

Figure 3:
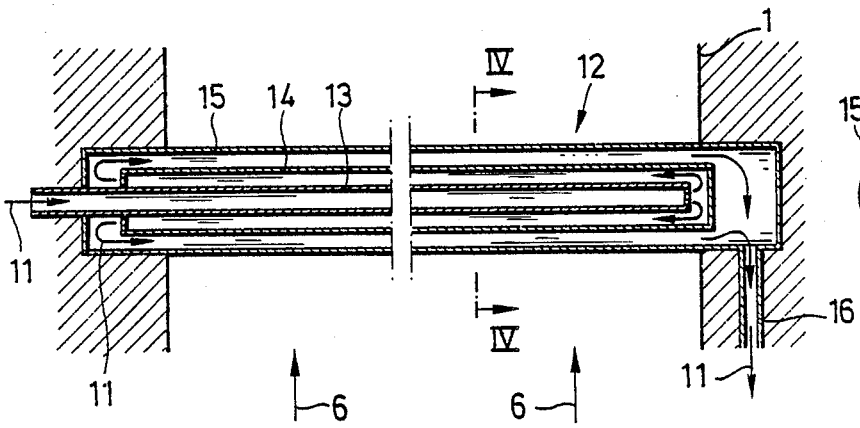
FIG. 3 is a longitudinal sectional view of a starter element of the invention.
Figure 4:
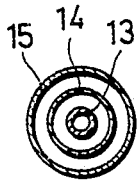
FIG. 4 is a sectional view along section line IV—IV of FIG. 3.

Each starter element 12 consists of a plurality of coaxially interpenetrating tubes 13, 14 and 15. Three are used in this construction. The feed water 11 coming out of the feed water header or inlet 7 flows through the innermost tube 13 into the starter element 12. This innermost tube 13 ends at a distance prior to the end of the surrounding middle tube 14. This end of tube 14 is closed. The middle tube 14, which is arranged to have a clearance between the inner tube 13 and the outer tube 15, is open at the side into which the inner tube 13 is inserted into the tube 14, and ends at a distance prior to an end of the outer tube 15. The outer tube 15 is closed at its two ends and includes an outlet 16 near one end as seen in FIG. 3, for the flow 11. Element 12 is connected to economizer 3. In boilers without economizers, outlet 16 is connected to the evaporator 4. The interior tubes 13 and 14 are constructed so as to be thin-walled since they are supposed to absorb only thermal shock stresses, without being exposed to steam pressure differences. Since the interior tubes 13 and 14 each have a free end, they can expand and contract freely without the occurrence of mechanical stresses which usually arise in clamped-in tubes. A crack in one of the inner tubes 13, 14 also does not impair the effectiveness or strength of the starter element 12 in any way.

Figure 2:
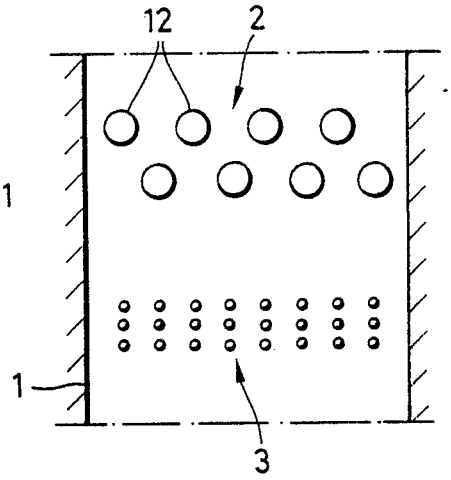
FIG. 2 is a cross-sectional view of the arrangement according to FIG. 1.
Figure 5:
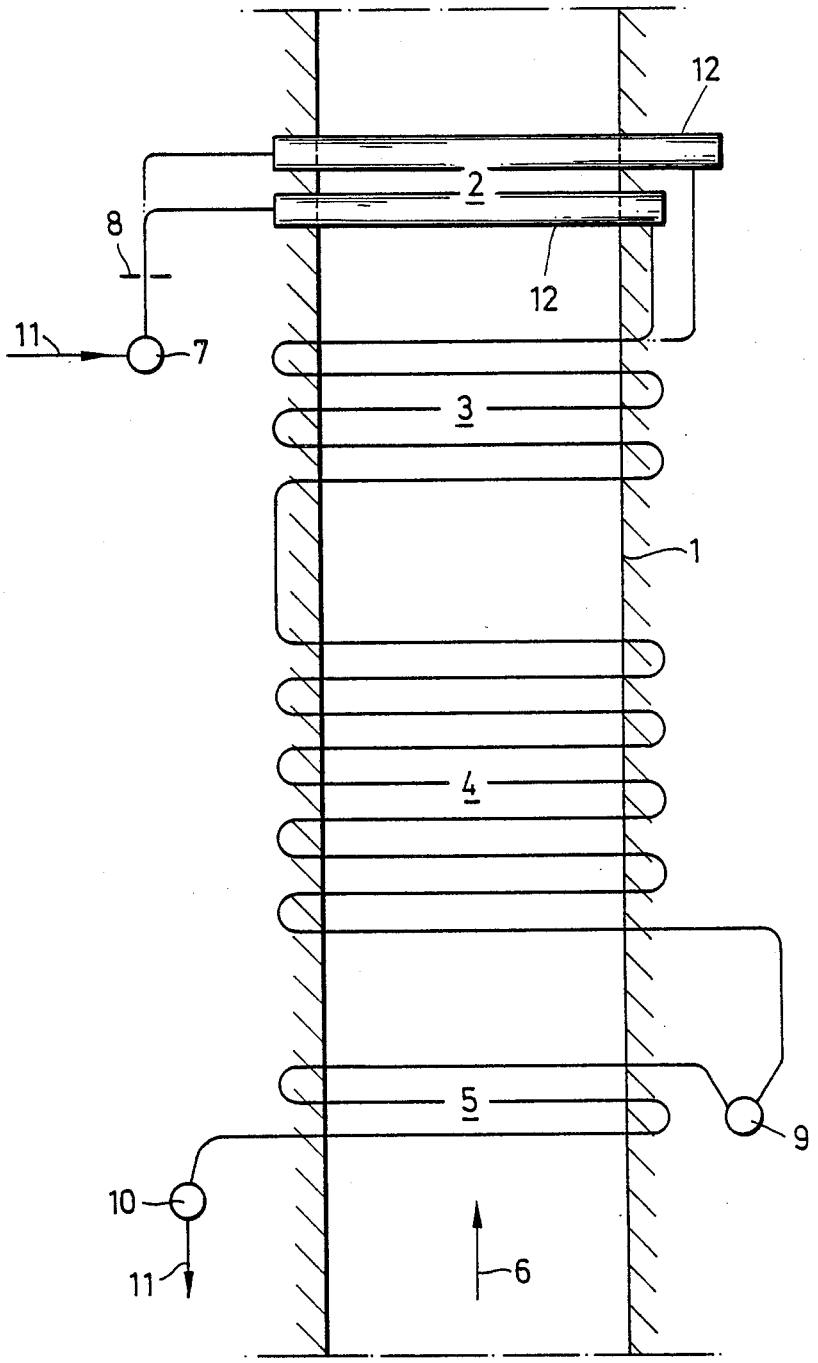
FIG. 5 is a schematic view of the construction of a once-through steam generator of the invention.

According to FIGS. 1, 2 and 5, a starter element 12 is connected in parallel upstream of each of the tubes of the economizer 3. However, it is possible to connect two or more elements 12 in tandem in order to increase the thermal shock absorbing effect. These starter elements 12 are constructed as constructional units and can be combined to form starters of different thermal capacities according to the building block principle.

Figure 6:
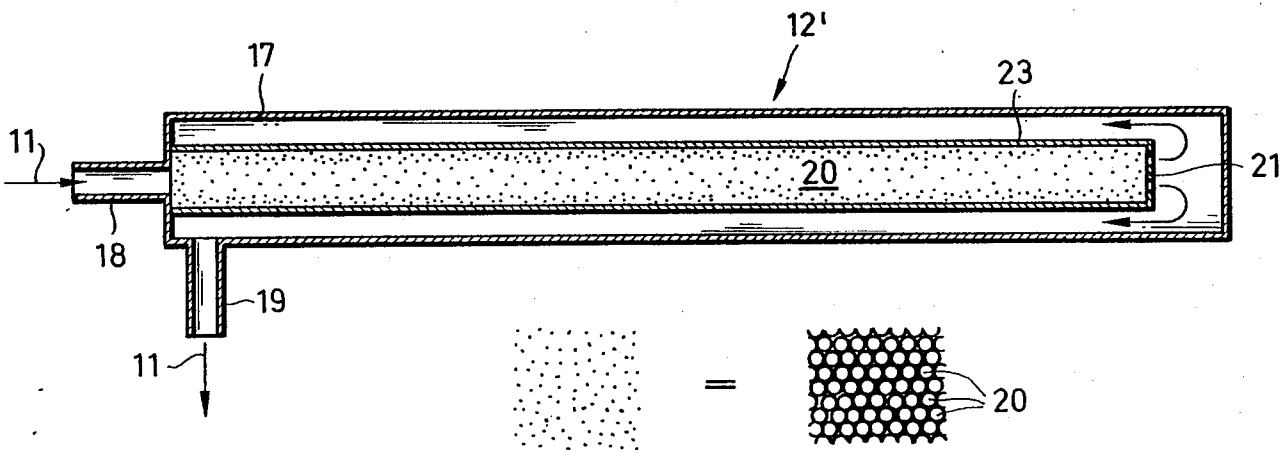
FIG. 6 shows another construction of a starter element of the invention with a hollow casing.

FIG. 6 shows another construction of a starter element 12', which, when connected in parallel and in a plurality above the economizer 3, can be used in the same way as the element 12 of the starter 2. The starter element 12', comprises a cylindrical hollow casing 17 and an internal tube 23. At one end, element 12', comprises an inlet opening 18 and an outlet opening 19. The inlet opening 18 is connected via pipes to the feed-water header 7 and the outlet tube 19 is connected via tubes to the economizer 3. Numerous heat accumulating bodies 20 in the form of balls are inserted inside the hollow internal tube 23 so as to loosely contact each other and are secured in the vicinity of the end of the tube 23 on the outflow side by means of a retaining screen 21. In operation, the feed-water flow may flow around the heat accumulating bodies 20 on virtually all sides so that a very high heat transfer surface is obtained when such starter elements 12', are used. The object of the internal tube 23 is to prevent the direct contact of water flowing into the element 12', via the inlet opening 18 with the external tube 17.

The aforementioned once-through boiler, which is equipped with a starter, works in the following manner: When the boiler is started from a cold state, feed water is fed to the boiler tubes which are later heated by means of the introduced hot gas mass flow 6 until the system is at operating temperature. Therefore, starting of the boiler from the cold state is effected as in conventional once-through boiler, wherein the starter 2 has no particular function, but rather, only serves to preheat water before the economizer 3. Thus the starter 2 works as an additional water preheating stage in normal operation.

The feed water enters the boiler 1 from the top through the throttle 8 from the feed-water header 7 arriving first in the starter 2, which is then working as a water preheater, and then arrives in the economizer 3, which is arranged below the accumulator 2, and to which the evaporator 4 located below this is connected, the feed water being evaporated into saturated steam in the evaporator 4. The saturated steam then arrives in the outlet header 9 which is connected to the superheater 5 in which the saturated steam is converted to superheated steam which is then fed to the steam turbine via the outlet header 10. The transformation of the feed water flowing into the boiler into superheated steam is effected by means of the hot gas mass flow 6 which is guided through the boiler pass 1 from the bottom to the top in an opposite flow direction and which has an inlet temperature of 300° C. to 600° C., for example. This hot gas mass flow 6 heats the tubes located in the boiler pass and, accordingly, the feed water. Because of the heat exchange between the gas and the water, different regions occur in the vertical direction of the boiler pass 1, i.e., from top to bottom, a water preheating region, an evaporation region and a superheating region (corresponding to the economizer 3, the evaporator 4 and the superheater 5) which have borders that can migrate relative to one another.

When starting the steam generator from the hot state, the boiler pass 1 and the tube system located therein consisting of starter 2, economizer 3, evaporator 4 and superheater 5, are heated to the temperature of the exhaust gas flow 6, since the feed-water feed is interrupted and the feed water contained in the boiler is completely evaporated. In order to restart the hot boiler, feed water is admitted directly to the boiler which is outfitted with the starter 2, while the exhaust gas flow 6 continues to flow through the boiler pass 1. The cold feed water which is introduced now first arrives in the starter 2. The feed water arriving in the hot starter 2 is evaporated and further heated over a short distance because of the great temperature difference and a considerable increase in volume takes place causing a steam pressure increase to occur. In the starter 2 which is shown in FIGS. 1 to 5 and which is constructed from coaxial tubes 13, 14, 15, the greatest temperature shock is effected at the inner tube 13 which, like the middle tube 14, need not support any further considerable forces since almost equal pressure prevails at both sides of the tube wall. The tube wall of the outer tube 15 indeed must absorb stresses due to steam pressure, but is only exposed to the temperature transients that have already been reduced beforehand in the internal tubes. Thus, the tubes 13, 14, 15 of the starter are subjected exclusively to stresses which do not lead to an impairment of their functioning.

Thus, from the starter 2, first superheated steam, then wet steam and finally preheated feed water arrive in the economizer 3 and are then further heated in the evaporator 4 and finally arrive in the form of steam in the superheater 5. In this way, the economizer 3, evaporator 4 and superheater 5 are not subjected to a temperature shock, but rather are continuously heated to operating temperature slowly and, accordingly, in a manner which is sparing of tube material.

Subsequently, since cold water is being fed into the starter 2 continuously, the point of transition from water to steam is displaced in the longitudinal direction of the inner tube 13 and finally also along the longitudinal direction of the middle tube 14. Due to the cooling effect, this transition migrates slowly through the starter until arriving at the outer tube 15 and, finally, into the area of the economizer 3 so that, after the startup, a normal operating temperature is adjusted in which the heated preheating zone advances until the economizer outlet and from there makes the transition into steam.

The starter 2 which is described with the aid of FIG. 6 and comprises elements 12, acts in the same manner as described above. In this construction, the hollow casing 17 is loaded by means of steam pressure which occurs during sudden evaporation of the feed water, but does not directly contact the feed water due to the internal tube 23. Rather, it is first cooled by means of the superheated steam forming at the heat accumulating balls 20. The heat accumulating balls 20 form the first contact surface with the feed water. Because of their high thermal capacity and their large effective heat exchange surface, the wall of the hollow casing 17 is effectively protected from a sudden shock caused by cold water. The heat accumulating balls 20 are not exposed to any tensile stresses due to steam pressure, but they must absorb thermal stresses exclusively, which is why they are arranged so as to be loosely arranged within the internal tube.

Figure 7:
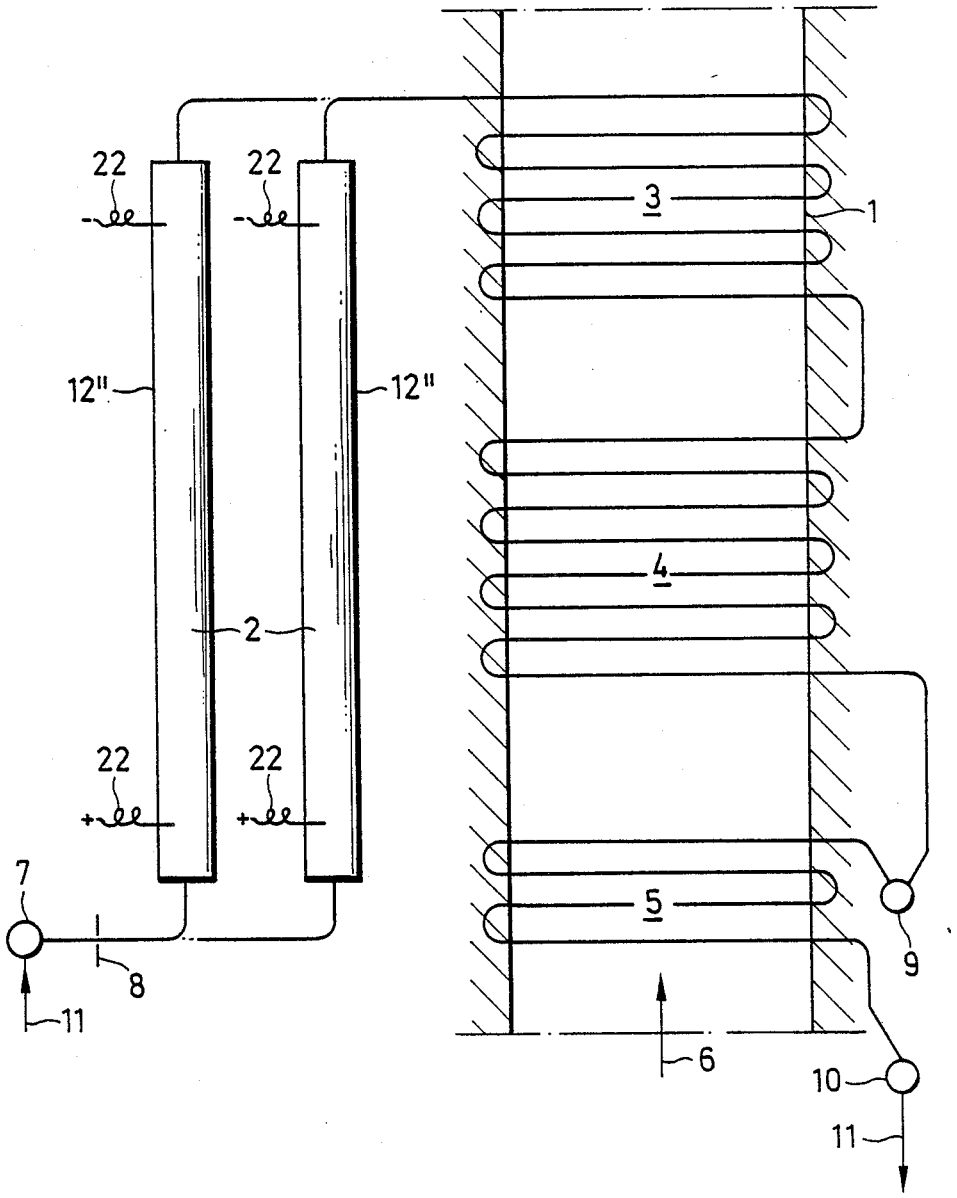
FIG. 7 shows an arrangement of an electrically heatable starter of the invention which is outside the boiler.

In the arrangement shown in FIG. 7, the starter 2 is arranged outside the boiler pass 1. This starter 2 is constructed from two starter elements 12" which are connected in parallel and constructed like the starter element 12' described with the aid of FIG. 6, but which comprise an electric heating means which is supplied with current via connections 22. The heat accumulating balls 20 arranged inside the starter elements of FIG. 7 can be heated by means of the electric heating means.

When starting the steam generator from the hot state, the starter elements 12" lying outside the boiler pass 1 and connected upstream of the economizer 3 are preheated to the desired temperature, after which the heating current is turned off and the feed water is admitted. The starter elements 12" then act as heat buffers in the same way as previously described and, accordingly, prevent excessively high thermal stresses, particularly in the region of the economizer 3.

As shown in the construction of FIG. 7, already existing systems can be outfitted subsequently with a starter which can be arranged in the vicinity of the boiler and is heatable by means of electricity or in some other manner.

While specific embodiments of the invention have been shown and described in detail to illustrate the application of the inventive principles, it will be understood that the invention may be embodied otherwise without departing from such principles.

What is claimed is:

1. A once-through steam generator comprising: a boiler pass defining a flow path for a hot gas mass flow flowing in a first direction; an economizer, evaporator and superheater connected in series in said boiler pass for leading a flow of water which progressively evaporates into superheated steam flowing in said economizer, evaporator and superheater, in a second direction which is opposite to said first direction; and starter means acting as a high-temperature heat accumulator and connected to said economizer upstream of said economizer in said second direction for preheating cold water before it is supplied to said economizer for hot startup of said economizer, evaporator and superheater without thermal shock thereon, after said starter, economizer, evaporator and superheater have been heated to the temperature of the hot gas mass flow.

2. A steam generator according to claim 1, wherein said starter means comprises a starter element having at least one inner member for initially receiving a supply of cold water and for initially converting the cold water into steam during an initial phase of the startup, said inner member being constructed so as to be relieved of stresses due to steam pressure and so as to receive thermal stresses, said starter means including an outer member enclosing said inner member and absorbing tensile stresses due to steam pressure.

3. A steam generator according to claim 2, wherein at least one starter element comprises a plurality of coaxial tubes one inside the other, each tube being attached at only one end for free thermal expansion and being made of relatively thin-walled material, said starter element comprising an outer tube made of relatively heavier material enclosing said coaxial tubes and extending coaxially around said coaxial tubes in said flow path.

4. A steam generator according to claim 2, wherein said at least one inner member comprises an inner tube filled with a multiplicity of heat accumulating bodies which are loosely arranged in said inner tube, and an outer hollow casing enclosing said inner tube.

5. A steam generator according to claim 1, wherein said starter means comprises a plurality of coaxially arranged tubes (13, 14, 15) which are arranged one inside the other at a distance relative to one another in such a way that an open end of an inner tube (13, 14) ends at a distance prior to an end of a surrounding tube (14, 15) which is closed, and wherein the outermost tube (15) is connected to said economizer (3) and the innermost tube (13) is connected to a source of feed water.

6. A steam generator according to claim 5, wherein said inner tubes (13, 14) are free of stress due to steam pressure and are constructed so as to have thin walls relative to said outermost tube.

7. A steam generator according to claim 1, wherein said starter means comprises three tubes (13, 14, 15) which are arranged one inside the other and which together form a starter element (12), a plurality of such starter elements (12) being connected in parallel to form said starter means.

8. A steam generator according to claim 1, wherein said starter means (2) comprises a hollow casing (17) through which feed water flows and which is filled with heat accumulating bodies (20) which are arranged within the hollow casing (17) so as to be loosely arranged and so that water and steam may flow around them.

9. A steam generator according to claim 8, wherein said hollow casing is constructed so as to be cylindrical and is arranged transversely relative to said hot gas mass flow passage.

10. A steam generator according to claim 8, wherein balls are provided as said heat accumulating bodies.

11. A steam generator according to claim 1, wherein a hollow casing (17) which is filled with heat accumulating bodies forms a starter element (12'), and a plurality of said starter elements being connected in parallel to form said starter means.

12. A once-through steam generator comprising: a boiler pass defining a first flow path for a hot gas mass flow flowing in a first direction; an economizer, evaporator and superheater connected in series in said boiler pass for leading a flow of water which progressively evaporates into superheated steam flowing in said economizer, evaporator and superheater forming a second flow path extending into said boiler pass and within said boiler pass flowing in a second direction which is opposite to said first direction; and starter means acting as a high-temperature heat accumulator and connected to said economizer in said second flow path up-stream of said economizer for preheating cold water before it is supplied to said economizer for hot startup of said economizer, evaporator and superheater without thermal shock thereon, said starter means (2) comprises a hollow casing (17) through which feed water flows and which is filled with heat accumulating bodies (20) loosely arranged within the hollow casing (17) so that water and steam may flow around them, and electrical heating means connected to said hollow casing for electrically heating said heat accumulating bodies (20).

* * * * *

UNITED STATES PATENT AND TRADEMARK OFFICE

CERTIFICATE OF CORRECTION

PATENT NO. : 4,915,062

DATED : April 10, 1990

INVENTOR(S) : Richard Dolezal

It is certified that error appears in the above-identified patent and that said Letters Patent is hereby corrected as shown below:

On the title page, the foreign priority data should read as follows:

--[30] Foreign Application Priority Data

Dec. 10, 1987 [DE] Fed. Rep. of Germany....3741882--.

Signed and Sealed this

Twenty-fourth Day of December, 1991

*Attest:*

HARRY F. MANBECK, JR.

*Attesting Officer*

*Commissioner of Patents and Trademarks*